US007128579B1

(12) United States Patent
Brodsky et al.

(10) Patent No.: US 7,128,579 B1
(45) Date of Patent: Oct. 31, 2006

(54) HOOK INTERCONNECT

(75) Inventors: William L. Brodsky, Binghamton, NY (US); James A. Busby, New Paltz, NY (US); Bruce J. Chamberlin, Vestal, NY (US); Mitchell G. Ferrill, Little Meadows, PA (US); Robin A. Susko, Owego, NY (US); James R. Wilcox, Vestal, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/161,858

(22) Filed: Aug. 19, 2005

(51) Int. Cl.
*H01R 12/00* (2006.01)

(52) U.S. Cl. ..... 439/66; 439/161; 439/907; 439/908

(58) Field of Classification Search ..... 439/66, 439/75, 161, 80, 751, 907, 908
See application file for complete search history.

(56) References Cited

U.S. PATENT DOCUMENTS 3,924,918 A * 12/1975 Friend ..... 439/75
4,620,761 A * 11/1986 Smith et al. ..... 439/372
5,567,167 A * 10/1996 Hayashi ..... 439/75
5,793,618 A 8/1998 Chan et al.
6,503,090 B1 * 1/2003 Onizuka ..... 439/75
6,551,112 B1 * 4/2003 Li et al. ..... 439/66
6,604,950 B1 8/2003 Maldonado et al.
6,617,522 B1 * 9/2003 Tabacutu ..... 174/260
6,674,672 B1 1/2004 Forbes et al.
6,974,339 B1 * 12/2005 Kuzmenka ..... 439/161
2002/0055282 A1 5/2002 Eldridge et al.
2003/0132513 A1 7/2003 Chason et al.
2003/0193093 A1 10/2003 Brofman et al.
2003/0203664 A1 10/2003 Koopman et al.
2004/0042183 A1 3/2004 Alcaria et al.
2005/0208788 A1 * 9/2005 Dittmann ..... 439/66
2006/0019508 A1 * 1/2006 Lin ..... 439/66

FOREIGN PATENT DOCUMENTS

JP 59-96755 * 6/1984

* cited by examiner

*Primary Examiner*—Tho D. Ta
(74) *Attorney, Agent, or Firm*—Gibb I.P. Law Firm, LLC; Ira D. Blecker, Esq.

(57) ABSTRACT

Disclosed is a semiconductor package structure that incorporates the use of conductive pins to electrically and mechanically connect a semiconductor module and a substrate (e.g., printed wiring board). Specifically, one or both ends of the pins are hooked and are adapted to allow a press-fit connection with the walls of the plated through holes of either one or both of the semiconductor module and the substrate. The hook-shaped ends of the pins may have one or more hooks to establish the connection. Additionally, the pins may be formed of a temperature induced shape change material that bends to allow engaging and/or disengaging of the hook-shaped ends from the walls of the plated through holes.

20 Claims, 5 Drawing Sheets

HOOK INTERCONNECT

BACKGROUND OF THE INVENTION

1. Field of the Invention

The invention relates generally to semiconductor packaging structures and, in particular, to interconnections between organic semiconductor modules and substrates such as printed wiring boards.

2. Description of the Related Art

Retention hardware incorporated into semiconductor packages often exerts excessive stress upon semiconductor modules and especially onto semiconductor modules designed with low insertion force or designed to be field replaceable. Excessive stress can cause reliability concerns for a semiconductor package. For example, the stress induced by retention hardware in land grid array or similar connection schemes used to connect organic modules to printed wiring boards can result in cracking, bowing, poor interconnect integrity, etc. The present invention, therefore, presents a low insertion force/low stress interconnect scheme.

SUMMARY OF THE INVENTION

In view of the foregoing, the structure of the invention provides a low insertion force interconnect scheme between two layers (e.g., between a printed circuit or wiring board and a semiconductor module). The interconnect scheme imposes low stress on the semiconductor module by incorporating the use of conductive pins with hooks that are easily press-fit into a plated through hole (i.e., the tip and backside of the hook grab the walls of the plated through hole (PTH) as the hook is inserted to provide both a mechanical and electrical connection). More particularly, the invention provides an interconnect scheme for connecting a substrate such as a printed circuit board or printed wiring board to a semiconductor module. The substrate and/or the semiconductor module have a plurality of plated through holes (i.e., first and second plated through holes, respectively). Conductive pins provide a mechanical and electrical connection between the semiconductor module and the substrate. In one embodiment each pin is soldered at a first end to the substrate and has a hook at a second end. The hook at the second end is adapted for press fitting into a corresponding through hole of the semiconductor module and for hooking to the plated wall of the through hole, thereby securing the semiconductor module to the substrate. In another embodiment each pin is soldered at a second end to the semiconductor module and has a hook at a first end. The hook at the first end is adapted for press fitting into a corresponding through hole of the substrate and for hooking to the plated wall of the through hole, thereby securing the semiconductor module to the substrate. In yet another embodiment, each pin has a first hook at a first end and a second hook at a second end. The first hook is adapted for press fitting into a corresponding first plated through hole of the substrate and for hooking to its plated wall. The second hook is adapted for press fitting into a corresponding second plated through hole of the semiconductor module and for hooking to its plated wall. Thus, the first and second hooks secure the semiconductor module to the substrate.

Each pin can further be plated with copper, nickel, and gold to provide improved conductivity and contact resistance. Each pin can also be readily detachable from the plated through walls, thus, allowing the semiconductor module to be readily detachable from the substrate. For example, a pin can comprise either a bimetallic structure or a shape memory alloy that can be adapted to bend in response a first temperature range such that the hook can be firmly engaged within a PTH or easily disengaged from a PTH. These, and other, aspects and objects of the present invention will be better appreciated and understood when considered in conjunction with the following description and the accompanying drawings. It should be understood, however, that the following description, while indicating embodiments of the present invention and numerous specific details thereof, is given by way of illustration and not of limitation. Many changes and modifications may be made within the scope of the present invention without departing from the spirit thereof, and the invention includes all such modifications.

BRIEF DESCRIPTION OF THE DRAWINGS

The invention will be better understood from the following detailed description with reference to the drawings, in which.

DETAILED DESCRIPTION OF PREFERRED EMBODIMENTS OF THE INVENTION

Figure 1:
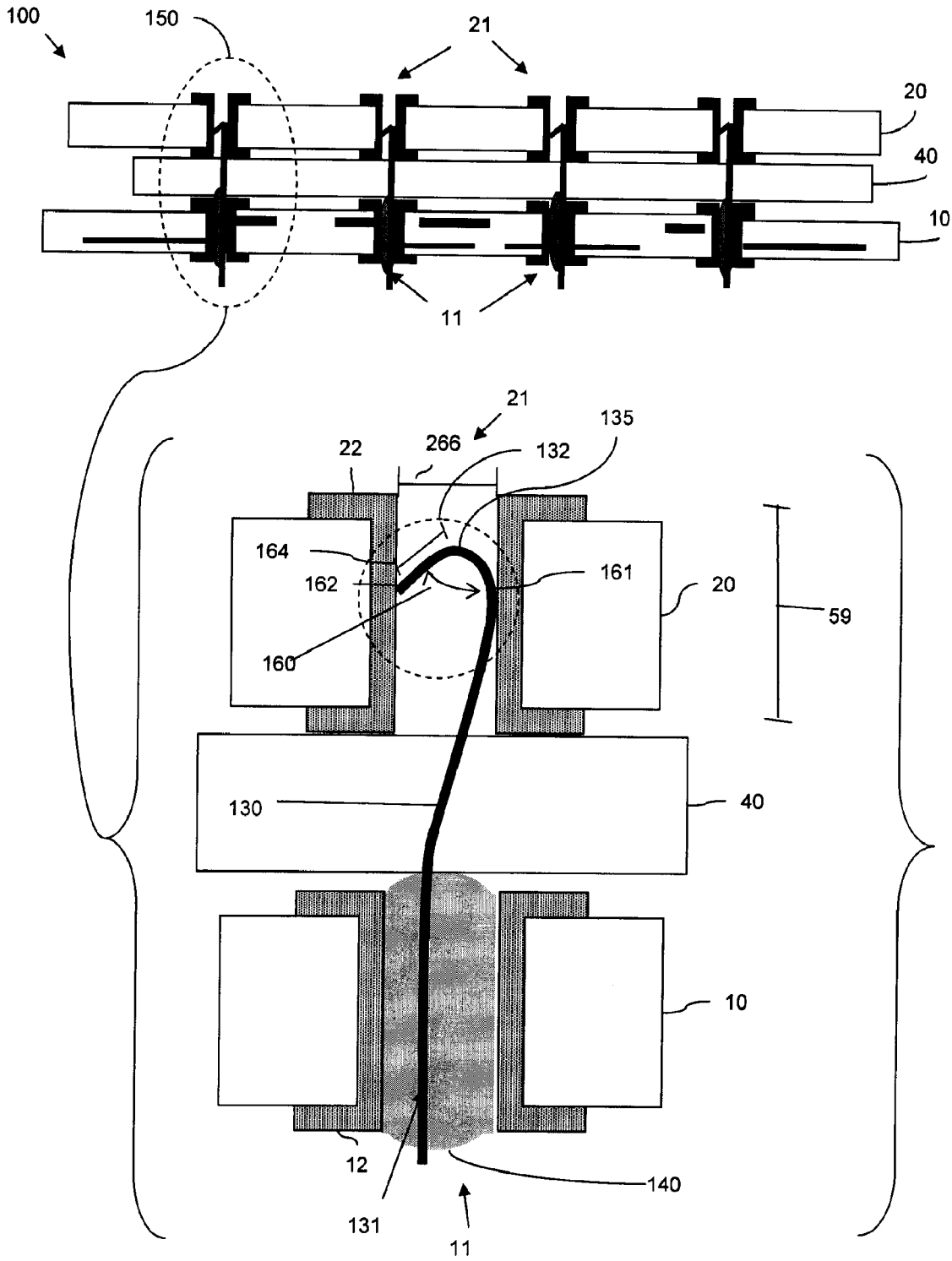
FIG. 1 is a schematic diagram of an embodiment of the invention, including an exploded view of the interconnection scheme.

The present invention and the various features and advantageous details thereof are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the present invention. The examples used herein are intended merely to facilitate an understanding of ways in which the invention may be practiced and to further enable those of skill in the art to practice the invention. Accordingly, the examples should not be construed as limiting the scope of the invention.

As mentioned above, prior art semiconductor packaging assemblies such as those incorporating land grid arrays often decreased package reliability by imposing stress on semiconductor module and thereby causing cracking, bowing, poor interconnect integrity, etc. The semiconductor package assembly of the invention provides a low insertion force interconnect scheme between a printed circuit/wiring board and a semiconductor module. The interconnect scheme imposes low stress on the semiconductor module by incorporating the use of pins with hooks that are easily press-fit into a plated through hole (PTH). The tip and backside of the hook grab the wall of the plated through hole providing an electrical connection and making removal difficult (i.e., a good mechanical connection). The mechanical and electrical connection may further be accomplished and/or enhanced by slightly backing the pin out of the PTH and/or by forming a pin as a bimetallic structure or with a shape memory alloy.

Figure 2:
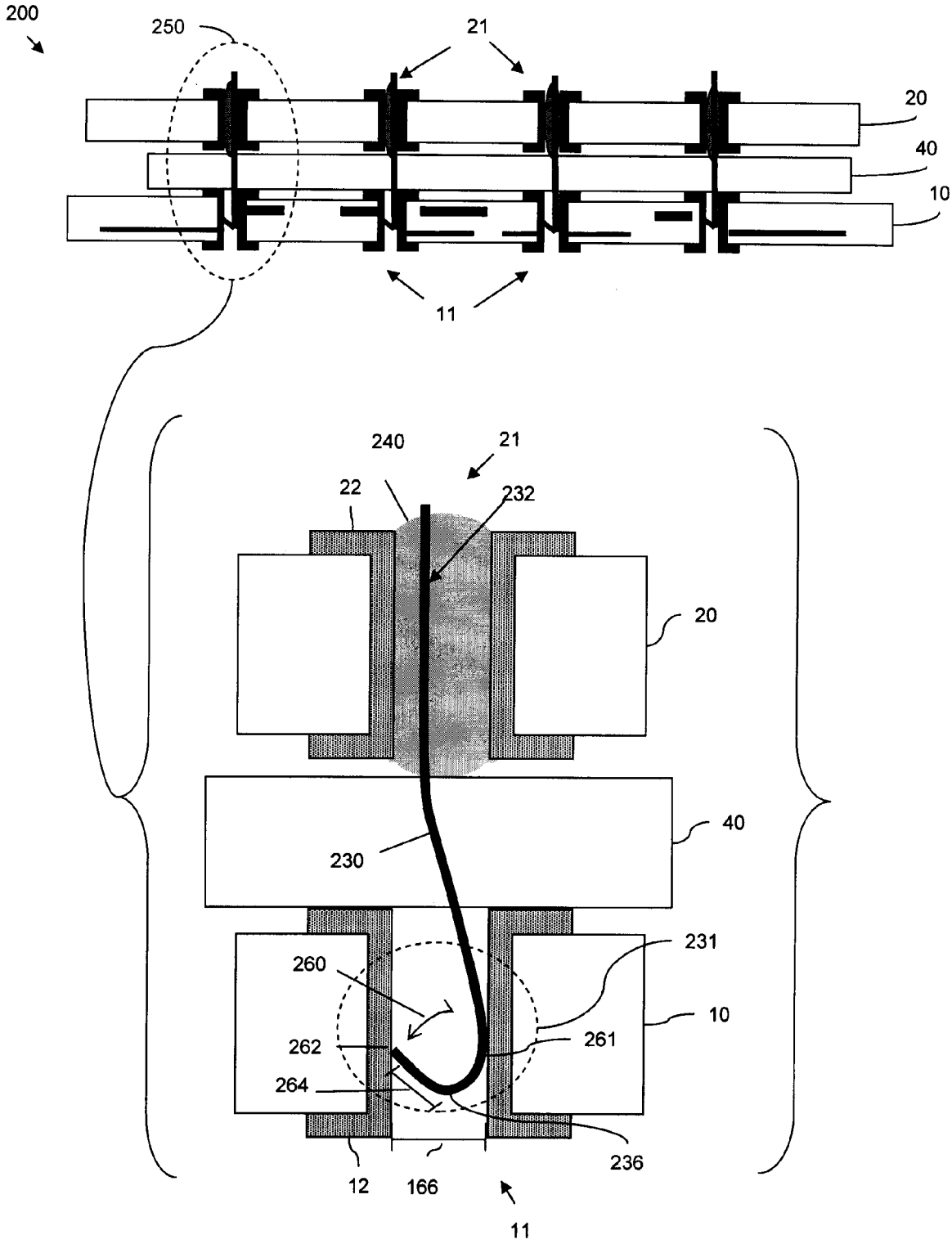
FIG. 2 is a schematic diagram of another embodiment of the invention, including an exploded view of the interconnection scheme.
Figure 3:
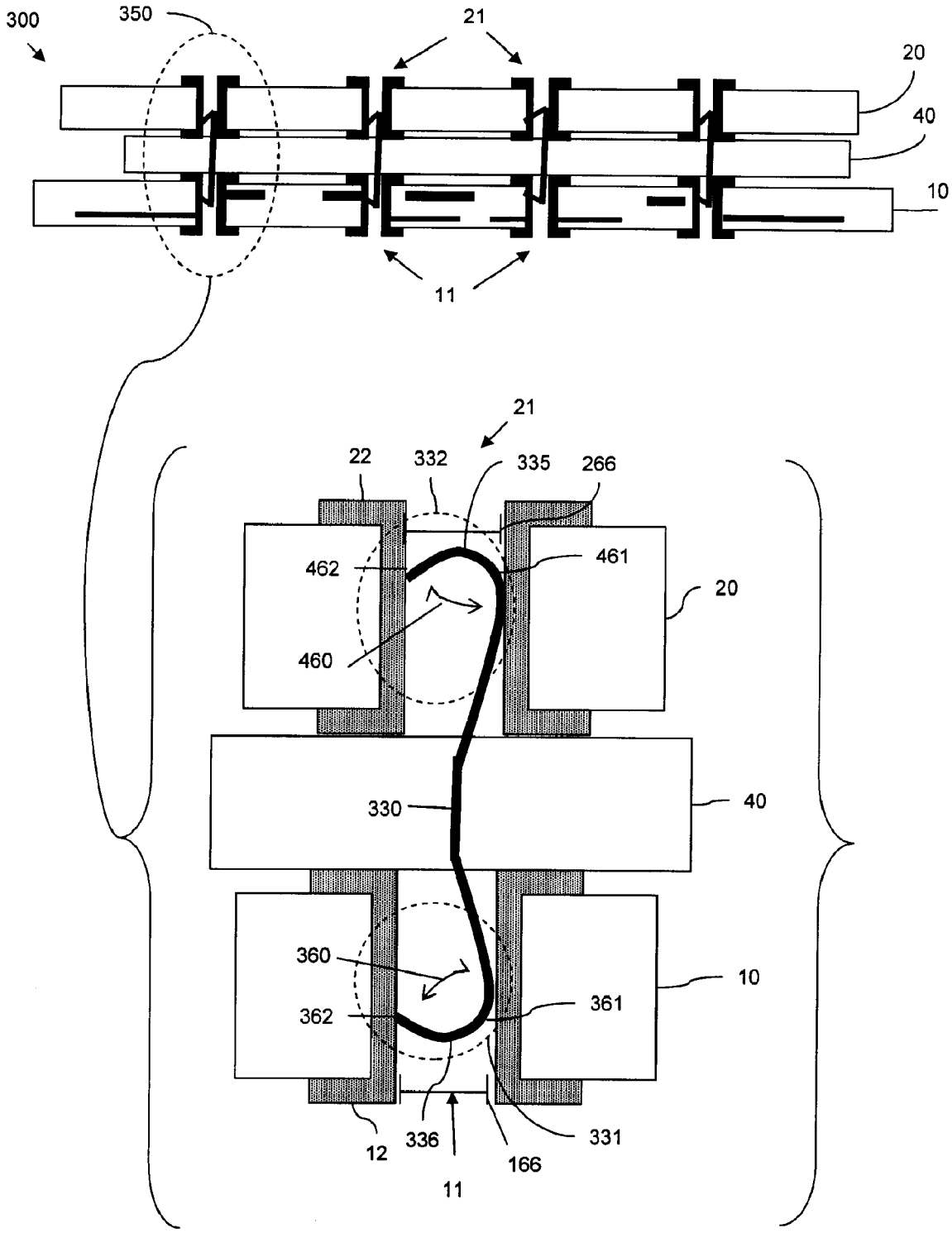
FIG. 3 is a schematic diagram of another embodiment of the invention, including an exploded view of the interconnection scheme.

More particularly, referring to the structures 100, 200, and 300 illustrated in FIGS. 1–3, respectively, the invention provides a method for electrically and mechanically connecting a first layer 10 (e.g., a substrate such as a printed circuit board or printed wiring board) with a second layer 20 (e.g., a semiconductor module such as an organic module). The first layer 10 and the second layer 20 each have a respective first conductor 12 and second conductor 22. For example, a printed wiring board (i.e., first layer 10) may have a first through hole 11 with first plated walls (i.e., first conductor 12) and a semiconductor module (i.e., second layer 20) may have a second through hole 21 with second plated walls (i.e., second conductor 22). A third conductor 130, 230, 330, (e.g., conductive pins, wires, etc.) provide a mechanical and electrical connection between the first layer 10 and the second layer 20 and particularly, between the first conductor 12 and second conductor 22. Because of the reduced stress on the organic module 20 compared with stress caused by land grid array retention hardware, the semiconductor packages 100, 200, 300 do not need to incorporate stress management hardware, such as stiffeners, retainers, springs, etc.

Figure 4:
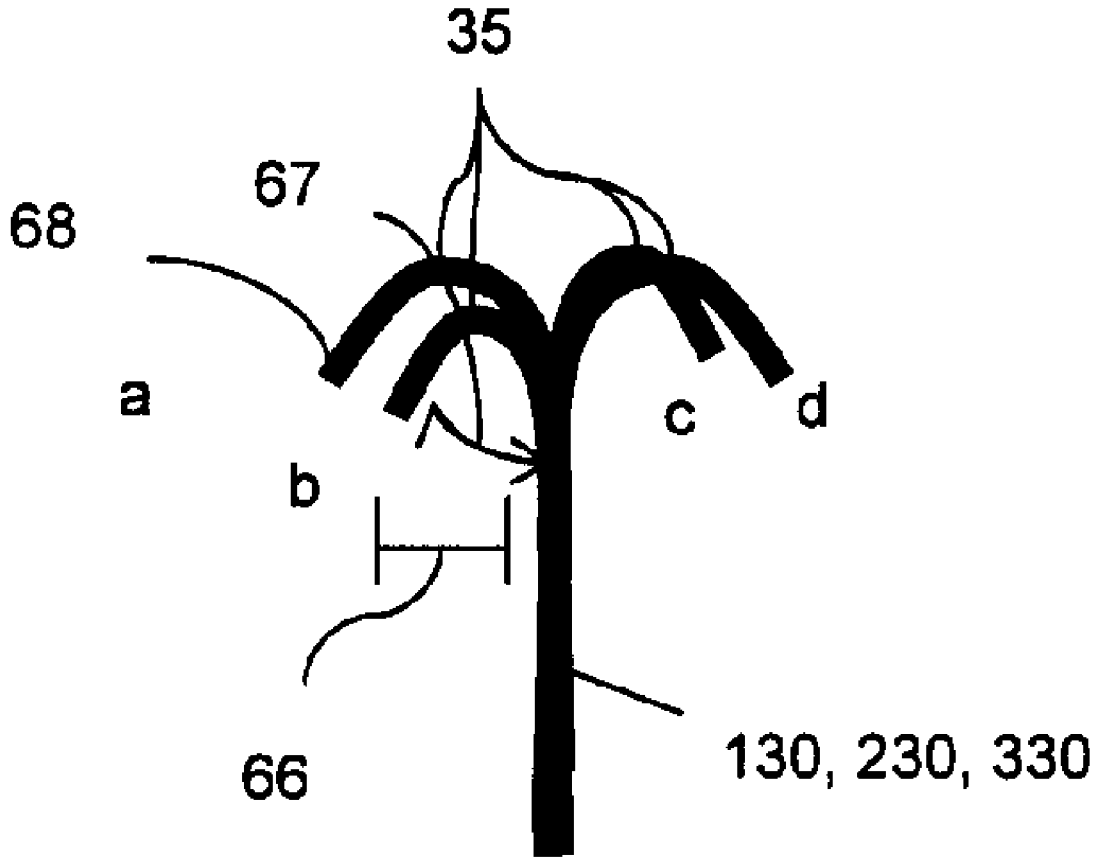
FIG. 4 is schematic diagram of an alternate hook for use with the interconnection scheme.

Referring particularly to structure 100 of FIG. 1, in one embodiment a third conductor 130 can have a soldered end 131 electrically and mechanically connected to the first conductor 12 of the first layer 10. For example, a solder ball 140 can connect the pin 130 and the plated walls (i.e., first conductor 12) of the first plated through holes 11. The third conductor 130 can also comprise a hook-shaped end 132. The hook-shaped end 132 of the pin (i.e., third conductor 130) may have a single hook 135, as illustrated in FIG. 1, or a plurality of hooks 35*a*–*d*, as illustrated in FIG. 4. The hook-shaped end 132 of the pin 130 is adapted to provide a press-fit connection between the substrate (i.e., first layer 10) and the semiconductor module (i.e., second layer 20). More particularly, the single hook 135 is adapted for press fitting into a corresponding plated through hole 21 of the second layer 20 such that the tip 162 and backside 161 of the hook 135 press against the plated wall (i.e., second conductor 22), thereby, securing the semiconductor module 20 to the substrate 10. Alternatively, referring to FIG. 4, the plurality of hooks 35*a*–*d* can be adapted for press fitting into the plated through hole 21 such that the tips 68*a*–*d* press against the plated wall 22, thereby, securing the semiconductor module 20 to the substrate 10.

Referring to the structure 200 of FIG. 2, in another embodiment a pin (i.e., a third conductor 230) can have a soldered second end 232 electrically and mechanically connected to the second conductor 22 of the second layer 20. For example, a solder ball 240 can connect third conductor 230 to the plated walls (i.e., second conductor 22) of the second plated through holes 21. The third conductor 230 can also comprise a hook-shaped end 231. As with the hook-shaped end of the previously described embodiment, the hook-shaped shaped end 231 may have a single hook 236, as illustrated in FIG. 2 or a plurality of hooks 681-*d*, as illustrated by hooks 35*a*–*d* of pin 30 of FIG. 4. The hook 236 or the plurality of hooks at the end 231 of the pin 230 are adapted to provide a press fit connection between the substrate (i.e., the first layer 10) and the semiconductor module (i.e., the second layer 20). More particularly, the single hook 236 is adapted for press fitting into a corresponding plated through hole 11 of the second layer 20 such that the tip 262 and backside 261 of the hook 236 press against the plated wall (i.e., first conductor 12), thereby, securing the semiconductor module 20 to the substrate 10. Alternatively, referring to FIG. 4, the plurality of hooks 35*a*–*d* can be adapted for press fitting into the plated through hole 11 such that the tips 68*a*–*d* press against the plated wall 12, thereby, securing the semiconductor module 20 to the substrate 10.

Referring to the structure 300 of FIG. 3, in yet another embodiment, a third conductor 330 can comprise a first hook-shaped end 331 and a second hook-shaped end 332. As with the previously described embodiments, the first and second hook-shaped ends 331, 332 of the pin (i.e., third conductor 330) may have either a single hook (e.g., first hook 336 and second hook 335), as illustrated in FIG. 3, or a plurality of hooks 35*a*–*d*, as illustrated in FIG. 4. The first and second hook-shaped ends 331, 332 of the pin 330 are adapted for providing a press fit connection between the substrate (i.e., the first layer 10) and the semiconductor module (i.e., the second layer 20). More particularly, the single first hook 336 and single second hook 335 are adapted for press fitting into a corresponding plated through holes 11, 21 such that the tips 362, 462 and backsides 361, 461 of the hooks 336, 335 press against the plated walls (i.e., first and second conductors 12, 22), thereby, securing the semiconductor module 20 to the substrate 10. Alternatively, referring to FIG. 4, the plurality of hooks 35*a*–*d* can be adapted for press fitting into the plated through holes 11, 21 such that the tips 68*a*–*d* press against the plated walls 12, 22, thereby, securing the semiconductor module 20 to the substrate 10.

Referring to FIGS. 1–3 in combination, for each structure 100, 200, 300, an interposer (i.e., third layer 40) may be positioned between the semiconductor module 10 and the substrate 20 in order to hold the pins (e.g., third conductors 130, 230, and 330) and to align the pins with the corresponding plated through holes.

Referring again to FIGS. 1–3 in combination, the first and second plated through holes 11, 21 (e.g., mounting holes) can range in finished diameter 166, 266 from between approximately 0.25 mm to 1.0 mm and the thickness of a finished printed circuit board or module carrier can range from between approximately 2 mm to 6 mm. The pins 130, 230, 330 can have a diameter ranging between approximately 0.1 mm to 0.35 mm, depending on the finished diameters 166, 266 of the through holes 11, 21. Single hooks 135, 236, 335, and 336, described above, can comprise "J"-shaped or check-mark shaped features having an angle (e.g., angle 160, 260, 360, 460) that can range between approximately 30 and 75 degrees. The shortest distance from a tip (e.g., see tips 162, 262, 363, 462) of a hook to the backside (e.g., see backside 161, 261, 361, 461) of a pin is approximately equal to or slightly greater than the diameter 165, 265 of the respective finished plated through hole 11, 21. In addition the maximum distance (e.g., see distance 164, 264, 364, 464) from the tip (e.g., see tips 162, 262, 362, 462) of the hook (e.g., see 135, 236, 335, 336, respectively) and the apex of the hook is no greater than half the length 59 of the plated through hole. Alternatively, if the hook-shaped ends of the pins 130, 230, 330 comprise a plurality of "J" or check-mark shaped equal size hooks, as illustrated in FIG. 4, the angle 67 between the tips 68 of the hooks and the body of the pin can also range between approximately 30 and 75 degrees but the shortest distance 66 from the tip 68 to the body of the pins is approximately equal to or slightly greater than half the diameter 65 of the finished plated through hole.

The pins (i.e., third conductors 130, 230, 330) can comprise a solid cylindrical conductive wire. The pins can also be plated with copper, nickel, and gold to provide improved conductivity and contact resistance and, thus, a more noble contact connection. Plating pin 130, 230, 330, allows it to provide a high speed, high input/output connection between the first conductor 12 of the first layer 10 (i.e., plating of first plated through hole 11) and the second conductor 22 of the second layer 20 (i.e., plating of the second plated through hole 22).

Figure 5:
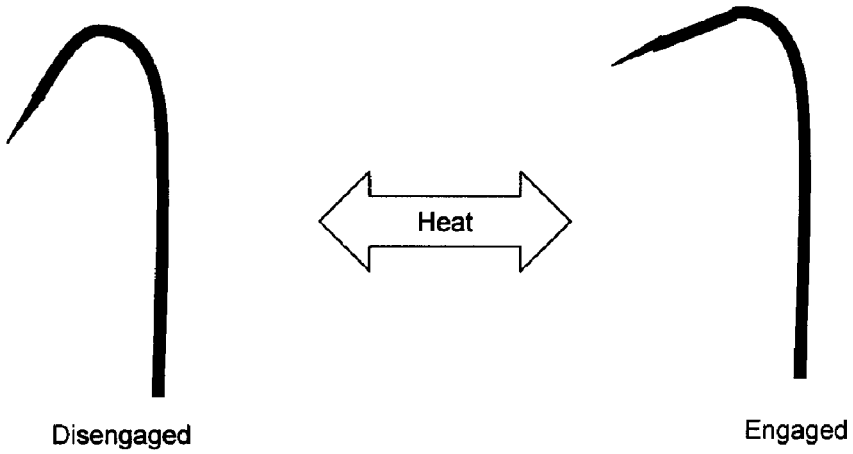
FIG. 5 is a schematic diagram illustrating an exemplary pin comprising a shape change material.
Figure 6:
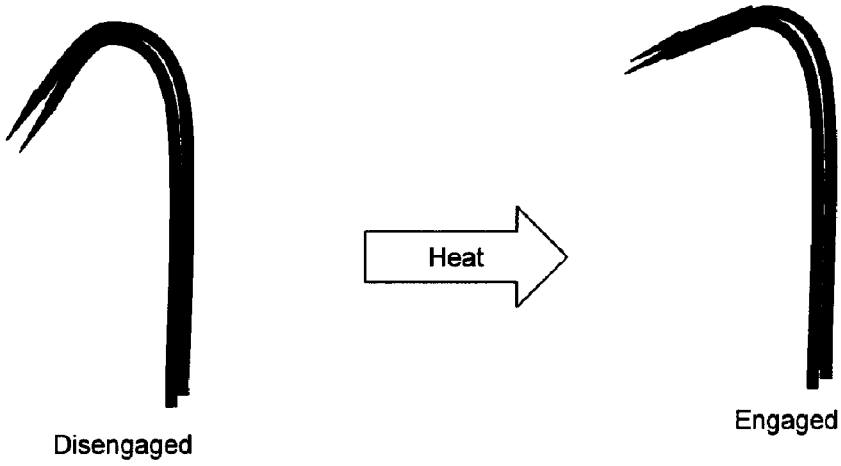
FIGS. 6 and 7 are schematic diagrams illustrating another exemplary pin comprising a shape change material.
Figure 7:
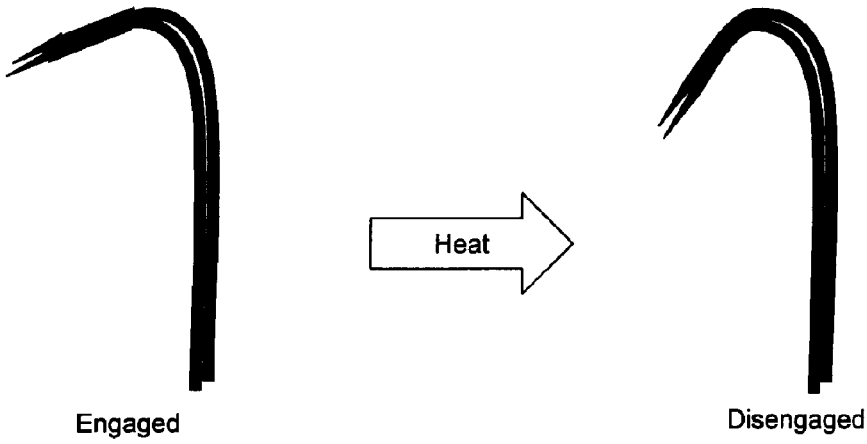

As discussed above, each pin 130, 230, 330 can comprise a solid cylindrical conductive wire. Alternatively, each pin (i.e., third conductor 130, 230, 330) can comprise a temperature induced shape changing material such as a shape memory alloy or a bimetallic structure such that the hook can bend and become engaged or disengaged, as designed, when subjected to a temperature change. Referring to FIG. 5, a pin may comprise a shape memory alloy such as a nickel titanium alloy (e.g., Nininol™) which can be factory formed at a high temperature and then deformed to a desired shape to either engage or disengage the hook. Specifically, the shape memory alloy can be selected and designed such that the hook engages upon heating to a predetermined temperature (e.g., the system operating temperature) to ensure that the pin remains in position during system operation. The alloy can alternatively be selected and designed such that the hook disengages upon heating to a predetermined temperature (e.g., a temperature above the operating temperature of the device such as a temperature greater than 175° C.) to allow the semiconductor package to be reworked. Those skilled in the art will recognize that with current state-of-the-art shape memory alloys temperature induced shape change is irreversible. Thus, temperature engagement or disengagement of a shape memory pin is single actuation event. Similarly, referring to FIGS. 6 and 7, the pin can be a bimetallic structure (e.g., a structure combination of copper, nickel, or Alloy 42) in which each metal responds to temperature changes (i.e., heating or cooling) by expanding and contracting at different rates causing the pin to bend. For example, as illustrated in FIG. 6, a bimetallic structure can be designed to engage the hook within the plated through hole upon heating and to disengage it upon cooling. It should be noted that the temperature required for disengagement should be well below the operating temperature to avoid unreliable connections in the field. Also for example, as illustrated in FIG. 7, a bimetallic structure can be designed to disengage the hook from the plated through hole upon heating or to engage it upon heating. In this example the heating temperature for disengagement should be well above the system operating temperature to avoid unreliable connections. Using a bimetallic pin structure is particularly useful because the shape changes are reversible upon subsequent heating and cooling. These shape changing pins, thereby, allow semiconductor modules 10 to be replaced and reworked during card/system assembly as well as in the field without damaging either the substrate 10 (e.g., the printed wiring board) or the semiconductor module 20 (e.g, the organic carrier).

Therefore, disclosed above is a structure with corresponding conductors, such as plated through holes, on two different layers that are electrically and mechanically connected by a third conductor or pin. The pin has at least one hook-shaped end that is adapted to engage the wall of a plated through hole to establish a mechanical and an electrical connection. The hooked-shaped end may have one or more hooks to establish this connection. In addition, the pin may be formed of a temperature induced shape change material that bends within different temperature ranges in order to engage or disengage the hook(s). Particularly, the pin can be formed with a shape change material that allows the pin to be easily disengaged (either irreversibly or reversibly) for the plated through hole so that the semiconductor package can be reworked as necessary. Thus, the resulting structure is an interconnect for a semiconductor package that requires low insertion force and no mechanical clamping force or hardware. Additionally, pin compliance will accommodate CTE mismatch between the substrates. By forming a semiconductor package with the hook interconnect, as described herein, the semiconductor package can be produced at a lower cost and with additional space available on the printed wiring board because no tooling holes or hardware are required. While the invention has been described in terms of embodiments, those skilled in the art will recognize that the invention can be practiced with modification within the spirit and scope of the appended claims.

What is claimed is:

1. A structure comprising:

a first layer comprising at least one first conductor;

a second layer adjacent said first layer, said second layer comprising at least one second conductor; and a third conductor connecting said first conductor to said second conductor, wherein said third conductor comprises a first end comprising a first hook with a first tip and wherein said first tip engages one of said first conductor and said second conductor to provide both an electrical connection and a mechanical connection.

2. The structure of claim 1, wherein said first layer comprises a through hole and wherein said first conductor comprises plated walls within said through hole.

3. The structure of claim 1, wherein said third conductor further comprises a second end comprising a second hook with a second tip, and wherein said first tip engages said fist conductor and said second tip engages said second conductor.

4. The structure of claim 1, wherein said third conductor comprises a second end that is opposite said first end and is solder connected to one of said first conductor and said second conductor.

5. The structure of claim 1, wherein said first end of said third conductor is adapted for providing a press-fit connection between said first layer and said second layer.

6. The structure of claim 1, further comprising a third layer between said first layer and said second layer, wherein said third conductor passes through said third layer.

7. The structure of claim 6, wherein said third layer is adapted to align said third conductor with said first conductor and said second conductor.

8. A structure comprising:

a first layer comprising at least one first conductor;

a second layer adjacent said first layer, said second layer comprising at least one second conductor; and a third conductor connecting said first conductor to said second conductor, wherein said third conductor comprises a first end comprising a first hook having a first tip, wherein said third conductor further comprises a temperature-induced shape change material that is adapted to bend such that said first tip engages one of said fist conductor and said second conductor when subjected to a first temperature range to provide both an electrical connection and a mechanical connection and disengages from said one of said first conductor and said second conductor when subjected to a second temperature range.

9. The structure of claim 8, wherein said shape change material comprises a bimetallic structure.

10. The structure of claim 8, wherein said shape change material comprises a shape memory alloy.

11. The structure of claim 8, wherein said first layer comprises a through hole and wherein said first conductor comprises plated walls within said through hole.

12. The structure of claim 8, wherein said third conductor comprises a second end comprising a second hook having a second tip, wherein said shape change material is adapted to bend such that said first tip engages said first conductor and said second tip engages said second conductor when subjected to said first temperature range and such that said first tip disengages from said first conductor and said second tip disengages from said second conductor when subjected to said second temperature range.

13. The structure of claim 8, wherein said third conductor comprises a second end that is opposite said first end and is solder connected to one of said first conductor and said second conductor.

14. The structure of claim 8, wherein said first end of said third conductor is adapted for providing a press fit connection between said first layer and said second layer.

15. The structure of claim 8, further comprising a third layer between said first layer and said second layer, wherein said third conductor passes through said third layer.

16. The structure of claim 15, wherein said third layer is adapted to align said third conductor with said first conductor and said second conductor.

17. A structure comprising:

a first layer comprising at least one first conductor;

a second layer adjacent said first layer, said second layer comprising at least one second conductor; and a third conductor connecting said first conductor to said second conductor, wherein said third conductor comprises a first end comprising a plurality of first hooks and wherein each of said first hooks has a first tip that is adapted to engage one of said first conductor and said second conductor to provide both an electrical connection and a mechanical connection.

18. The structure of claim 17, wherein said first layer comprises a through hole and wherein said first conductor comprises plated walls within said though hole.

19. The structure of claim 17, wherein said third conductor comprises a second end that comprises a plurality of second hooks, wherein each of said second hooks has a second tip, and wherein each of said first tips is adapted to engage said first conductor and wherein each of said second tips is adapted to engage said second conductor.

20. The structure of claim 17, wherein said third conductor comprises a second end that is opposite first end, and is solder connected to one of said first conductor and said second conductor.

* * * * *